US005647919A

United States Patent [19]

Kita et al.

[11] Patent Number: 5,647,919

[45] Date of Patent: Jul. 15, 1997

[54] HIGH STRENGTH, RAPIDLY SOLIDIFIED ALLOY

[75] Inventors: Kazuhiko Kita, Uozu; Hidenobu Nagahama, Kurobe, both of Japan

[73] Assignee: YKK Corporation, Tokyo, Japan

[21] Appl. No.: 318,531

[22] Filed: Oct. 5, 1994

Related U.S. Application Data

[63] Continuation of Ser. No. 7,570, Jan. 22, 1993, abandoned.

[30] Foreign Application Priority Data

Feb. 14, 1992 [JP] Japan ..... 4-028022

[51] Int. Cl.[6] ..... C22C 21/00

[52] U.S. Cl. ..... 148/437; 148/438; 148/440; 420/538; 420/547; 420/550; 420/551

[58] Field of Search ..... 148/437, 438, 148/439, 440, 420, 403; 420/405, 406, 402, 551, 535, 543, 544, 531, 537, 538, 540, 546, 548, 549, 552, 547

[56] References Cited

U.S. PATENT DOCUMENTS

| | | | |
|---|---|---|---|
| 4,675,157 | 6/1987 | Das et al. | 420/405 |
| 5,053,085 | 10/1991 | Masumoto et al. | 148/438 |
| 5,509,978 | 4/1996 | Masumoto et al. | 420/538 |

*Primary Examiner*—George Wyszomierski

*Attorney, Agent, or Firm*—Flynn, Thiel, Boutell & Tanis, P.C.

[57] ABSTRACT

A high strength, rapidly solidified alloy consisting of aluminum and, added thereto, additive elements. The mean crystal grain size of the aluminum is 40 to 1000 nm, the mean size of particles of a stable phase or a metastable phase of various intermetallic compounds formed from the aluminum and the additive element and/or various intermetallic compounds formed from the additive elements themselves is 10 to 800 nm, and the intermetallic compound particles are distributed in a volume fraction of 20 to 50% in a matrix consisting of aluminum. The rapidly solidified alloy has an improved strength at room temperature and a high toughness and can maintain the properties inherent in a material produced by the rapid solidification process even when it undergoes a thermal influence during working.

4 Claims, 3 Drawing Sheets

HIGH STRENGTH, RAPIDLY SOLIDIFIED ALLOY

This application is a continuation of U.S. Ser. No. 08/007 570, filed Jan. 22, 1993, now abandoned.

BACKGROUND OF THE INVENTION

1. Field of the Invention

The present invention relates to a high strength, rapidly solidified alloy which is produced by the rapid solidification process and has excellent strength as well as toughness. 2. Description of the Prior Art An aluminum-based alloy having a high strength and a high heat resistance has hitherto been produced by the liquid quenching process or the like. In particular, an aluminum alloy produced by the liquid quenching process disclosed in Japanese Patent Laid-Open No. 275732/1989 is in an amorphous or finely crystalline form and is an excellent alloy with a high strength, a high heat resistance and a high corrosion resistance.

Although the above-described conventional aluminum-based alloy is an alloy having a high strength, a heat resistance and a high corrosion resistance, and is excellent in workability as a high strength material, there is a room for improvement in toughness as a material required to have a high toughness. In general, an alloy produced by the rapid solidification process is liable to undergo a thermal influence during working, and the thermal influence causes excellent properties, such as strength, to be rapidly lost. This is true of the above-described alloy, so that there is room for an improvement in this respect as well.

SUMMARY OF THE INVENTION

In view of the above-described problem, the present inventors have paid attention to the volume fraction of various intermetallic compounds formed from a main metal element and additive elements, or from the additive elements themselves, dispersed in a matrix consisting of the main metal, and an object of the present invention is to provide a high strength, rapidly solidified aluminum alloy which has an improved strength at room temperature, and a high toughness and can maintain the properties inherent in a material produced by the rapid solidification process, even when it undergoes a thermal influence during working.

In order to solve the above-described problem, the present invention provides a high strength, rapidly solidified alloy consisting of a main metal element and, added thereto, additive elements, characterized in that the mean crystal grain size of the main metal element is 40 to 1000 nm, the mean particle size of a stable phase or a metastable phase of various intermetallic compounds formed from the main metal element and the additive elements and/or various intermetallic compounds formed from the additive elements themselves is 10 to 800 nm, and the intermetallic compound particles are distributed in a volume fraction of 20 to 50% in a matrix consisting of the main metal element.

DETAILED DESCRIPTION OF THE PREFERRED EMBODIMENTS

Figure 1:
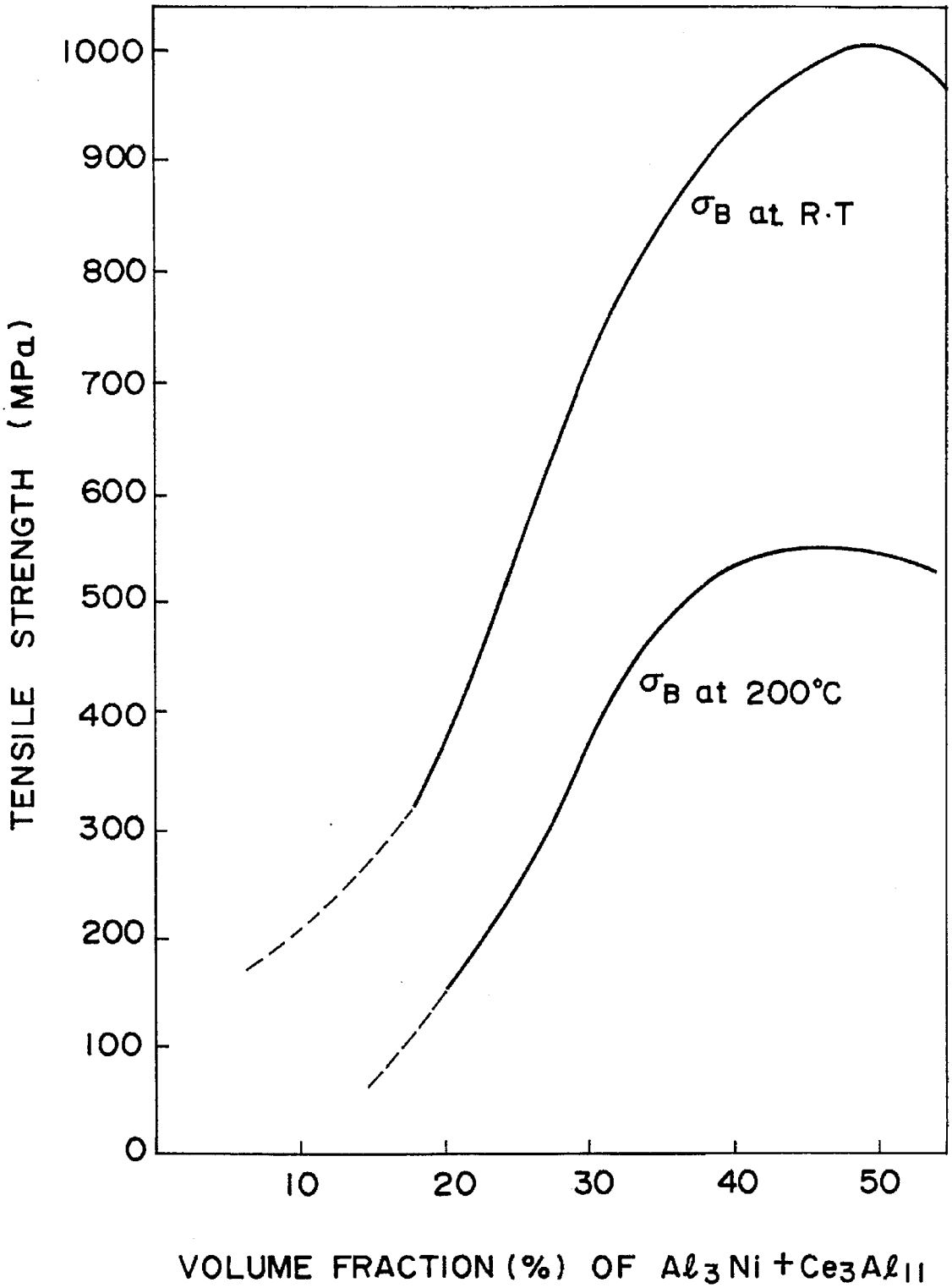
FIGS. 1, 2, and 3 are each a graph showing the relationship between the volume fraction of a compound phase and the tensile strength in the alloys described in the Examples of the present invention.

In the above-described alloy, the mean crystal grain size of the main metal element is that of a matrix consisting of the main metal element or a supersaturated solid solution of the main metal element. The mean crystal grain size of the matrix is limited to 40 to 1000 nm because when it is less than 40 nm, the ductility is unsatisfactory, although the strength is high, while when it exceeds 1000 nm, it becomes impossible to prepare a high strength alloy due to a rapid lowering in the strength.

The mean particle size of the intermetallic compounds is the mean particle size of a stable phase or a metastable phase of various intermetallic compounds formed from the above-described matrix element and other alloying elements and/or various intermetallic compounds formed from other alloying elements themselves. The mean particle size is limited to 10 to 800 nm because when it is outside this range, the intermetallic compounds do not. function as a strengthening element for the main metal element matrix. Specifically, when the mean particle size is less than 10 nm, the intermetallic compounds do not contribute to strengthening of the matrix. In this case, when the intermetallic compounds are excessively dissolved in the solid solution form in the matrix, there is a possibility that the material might become brittle. On the other hand, when the mean particle size exceeds 800 nm, the particle size becomes so large that the strength cannot be maintained and, at the same time, the intermetallic compounds do not function as a strengthening element.

When the mean crystal grain size of the main metal element and the mean particle size of the intermetallic compounds are in the above-described respective ranges, it becomes possible to improve the Young's modulus, high-temperature strength and fatigue strength. In order to attain the above-described object, it is necessary that particles of various intermetallic compounds should be dispersed and present together in a matrix of the main metal element.

The volume fraction of the particles of the intermetallic compounds to be incorporated into the the main element matrix is limited to 20 to 50% because when the volume fraction is less than 20%, the increase in strength at room temperature and the rigidity is unsatisfactory, whereas when the volume fraction exceeds 50%, the ductility at room temperature is so poor that the working of the resultant alloy is unsatisfactory, which makes it impossible to attain the object of the present invention.

Regarding the above-described main metal element and additive elements, the main metal element is Al or Mg, and the additive elements preferably consist of a first additive element consisting of at least one element selected from among rare earth elements (including Y), Zr and Ti and a second additive element consisting of at least one element selected from among transition elements exclusive of the elements belonging to the first additive element, Li, Si, Mg and Al. When the main metal element is Al, the second additive element is exclusive of Al. When the main metal element is Mg, the second additive element is exclusive of Mg. Further, Mm (mischmetal) which is a composite consisting of La and Ce as major elements and further rare earth (lanthanoid) elements exclusive of La and Ce and unavoidable impurities (Si, Fe, Mg, Al, etc.) as well belongs to the rare earth element of the first additive element.

Specific examples of the above-mentioned aluminum alloys include (I) an alloy represented by the general formula $Al_{100-a-b}X_aM_b$, wherein X represents at least one element selected from among La, Ce, Mm, Zr, Ti and Y; M represents at least one metal selected from Ni and Co; and a and b are each an atomic %, provided that $0.1 \leqq a \leqq 5$ and $5 \leqq b \leqq 10$; and (II) an alloy represented by the general formula $Al_{100-a-b-c}X_aM_bQ_c$, wherein X represents at least one element selected from among La, Ce, Mm, Zr, Ti and Y; M represents at least one metal selected from Ni and Co; Q represents at least one element selected from among Mg, Si, Cu and Zn; and a, b and c are each an atomic %, provided that $0.1 \leqq a \leqq 5$, $5 \leqq b \leqq 10$ and $0.1 \leqq c \leqq 2$.

The values of a, b and c in the above-described general formulae are limited to 0.1 to 5, 5 to 10 and 0.1 to 2, respectively, in terms of atomic % because when a, b and c are in the above-described respective ranges, the strength of the alloys at a temperature in the range of from room temperature to 300° C. is higher than that of the conventional (commercially available) high strength aluminum alloys and the alloys have a ductility sufficient to withstand practical working.

The X element is at least one element selected from among La, Ce, Mm, Ti and Zr. It has a small diffusibility in the Al matrix, forms various metastable or stable intermetallic compounds and contributes to the stabilization of a microcrystalline structure.

In the above general formulae, the M element is at least one element selected from Ni and Co. It has a relatively small diffusibility in the Al matrix. When it is finely dispersed as intermetallic compounds in the Al matrix, it has the effect of strengthening the matrix and, at the same time, regulating the growth of crystal grains. Specifically, it contributes to a remarkable improvement in the hardness, strength and rigidity of the alloy and stabilizes the microcrystalline phase not only at room temperature but also at high temperature, so that heat resistance can be imparted to the material.

The combination of the above-described elements gives the ductility necessary for the existing working to be imparted.

The Q element is at least one element selected from among Mg, Si, Cu and Zn, and combines with Al to form compounds or combines with another Q element to form compounds, thus strengthening the matrix and contributing to an improvement in the heat resistance. Further, the specific strength and specific modulus are improved.

In the alloys represented by the above-described general formulae as well, for the reasons set out above, the mean crystal grain size of a matrix of Al or a supersaturated solid solution of Al should be 40 to 1000 nm, the mean size of particles of a stable phase or a metastable phase of various intermetallic compounds formed from the above-described matrix element and other alloying elements and/or various intermetallic compounds formed from other alloying elements themselves should be 10 to 800 nm, and the volume fraction of the intermetallic compound particles incorporated into the Al matrix should be 20 to 50%.

Further, in the alloys represented by the general formulae, the volume fraction of the Al-X type compound is preferably 1 to 30%. When the volume fraction is less than 1%, the matrix is coarsened and the strength is lowered. On the other hand, when the volume fraction exceeds 30%, the ductility lowers extremely. The volume fraction of the Al-M type compound is preferably 19 to 40%. When the volume fraction is less than 19%, the strength at room temperature lowers, while when the volume fraction exceeds 40%, the ductility lowers.

In particular, in the alloys represented by the above-described general formulae, preferred examples of the dispersed Al-M type compound include $Al_3Ni$ and $Al_9Co_2$ and preferred examples of the Al-X type compound include $Ce_3Al_{11}$, $Al_4Ce$, $La_3Al_{11}$, $Mm_3Al_{11}$, $Al_3Ti$ and $Al_3Zr$. In both $Al_3Ti$ and $Al_3Zr$, a compound of a metastable phase has a higher effect of contribution to a fine dispersion.

The alloy of the present invention can be directly prepared in the form of a thin ribbon, powder, fine wire, etc., by a liquid quenching process such as the single-roller melt-spinning process, the gas or water atomization process or the in-rotating-water melt-spinning process through the proper regulation of the cooling rate of the ordinary solidification process to $10^7$ to $10^2$ K/sec.

Further, it can be directly prepared in the form of a foil by vapor phase deposition means such as sputtering, ion beam sputtering, vapor deposition or the like.

Similarly, the powder can be prepared also by the mechanical alloying process (MA process).

A consolidated material of the alloy according to the present invention can be directly prepared by two-stage solidification means as described in Japanese Patent Laid-Open No. 253525/1991 through a proper control of the cooling rate. When the alloy is prepared in the form of a consolidated material, a material in the form of a thin ribbon, powder, fine wire, foil or the like prepared by the above-described process may be consolidated and worked by the conventional plastic deforming means.

In this case, a powder, flake or the like having a fine structure prepared by rapid solidification or the like is desirably subjected to plastic deformation at a temperature of preferably 50° to 500° C., more preferably 320° to 440° C. The heat history in this case provides a more suitable crystalline structure.

In the above-described process, when the mechanical alloying process is used, an oxide, nitride or the like is formed. A material prepared by compacting and consolidating the above material has a superior strength at high temperature.

The alloy of the present invention produced by the above-described process enables superplastic working or diffusion bonding when the superplastic working is conducted at a temperature in the range of from 300° to 600° C. and at a rate of strain in the range of from $10^{-3}$ to $10^2$ $S^{-1}$.

The present invention will now be described in more detail by referring to the following Examples.

EXAMPLE 1

An aluminum-based alloy powder ($Al_{bal}Ni_{5-10}Ce_{0.5-4}$) having a predetermined composition was prepared by a gas atomizing apparatus. The aluminum-based alloy powder thus produced was filled into a metallic capsule, and a billet for extrusion was prepared with degassing. This billet was extruded at a temperature of 320° to 440° C. by an extruder to prepare samples.

The relationship between the mechanical properties (tensile strength) at room temperature and 200° C. and the volume fraction of the precipitated intermetallic compounds was determined for individual samples (materials consolidated by extrusion) produced under the above-described production conditions.

The results are shown in FIG. 1.

The volume fraction of the above-described intermetallic compounds was measured by subjecting the resultant consolidated material to an image analysis under a TEM. The intermetallic compounds precipitated from the above-described samples were mainly $Al_3Ni$, $Ce_3Al_{11}$, etc. Observation under a TEM revealed that the above-described samples each comprised a matrix consisting of aluminum or a supersaturated solid solution of aluminum, and having a mean crystal grain size of 40 to 1000 nm, that particles consisting of a stable phase or a metastable phase of various intermetallic compounds formed from the matrix element and other alloying elements and/or various intermetallic compounds formed from other alloying elements themselves were homogeneously distributed in the matrix, and that the mean particle size of the particles of the intermetallic compounds was 10 to 800

As is apparent from FIG. 1, the strength at room temperature and the strength at 200° C. rapidly increased when the volume fraction exceeded 20% and gradually decreased when the volume fraction exceeded about 50%.

The ductility of the sample at room temperature decreased with an increasing volume fraction of the intermetallic compound particles, and became lower than the lower limit (2%) of the ductility necessary for general working when the volume fraction exceeded 50%.

Changes in the strength at room temperature and the strength at a high temperature of 200° C. with the variation in the volume fraction of individual intermetallic compound particles were determined for $Al_3Ni$ and $Ce_3Al_{11}$ as main intermetallic compounds in individual samples produced under the above-described production conditions.

Figure 2:
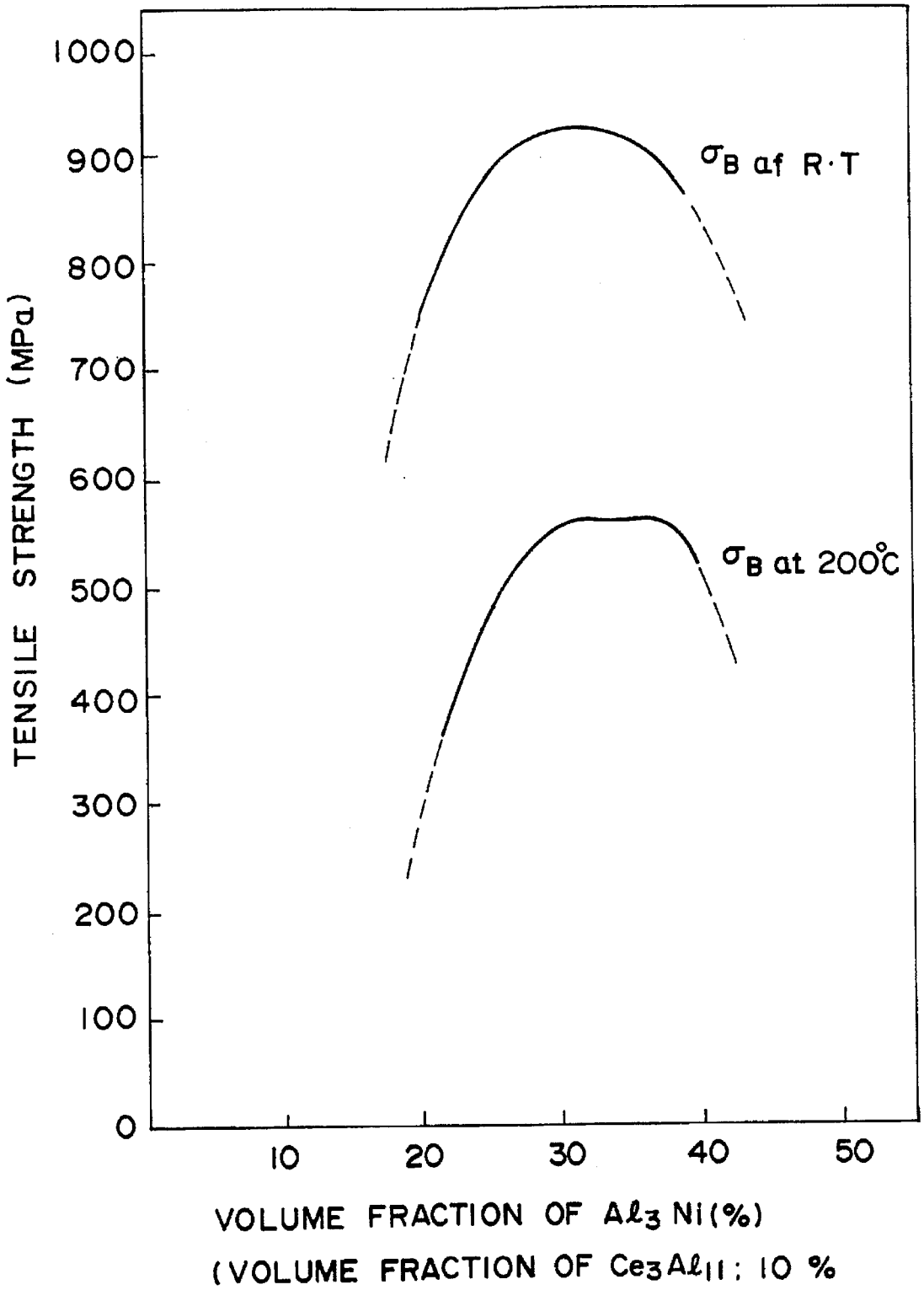
Figure 3:
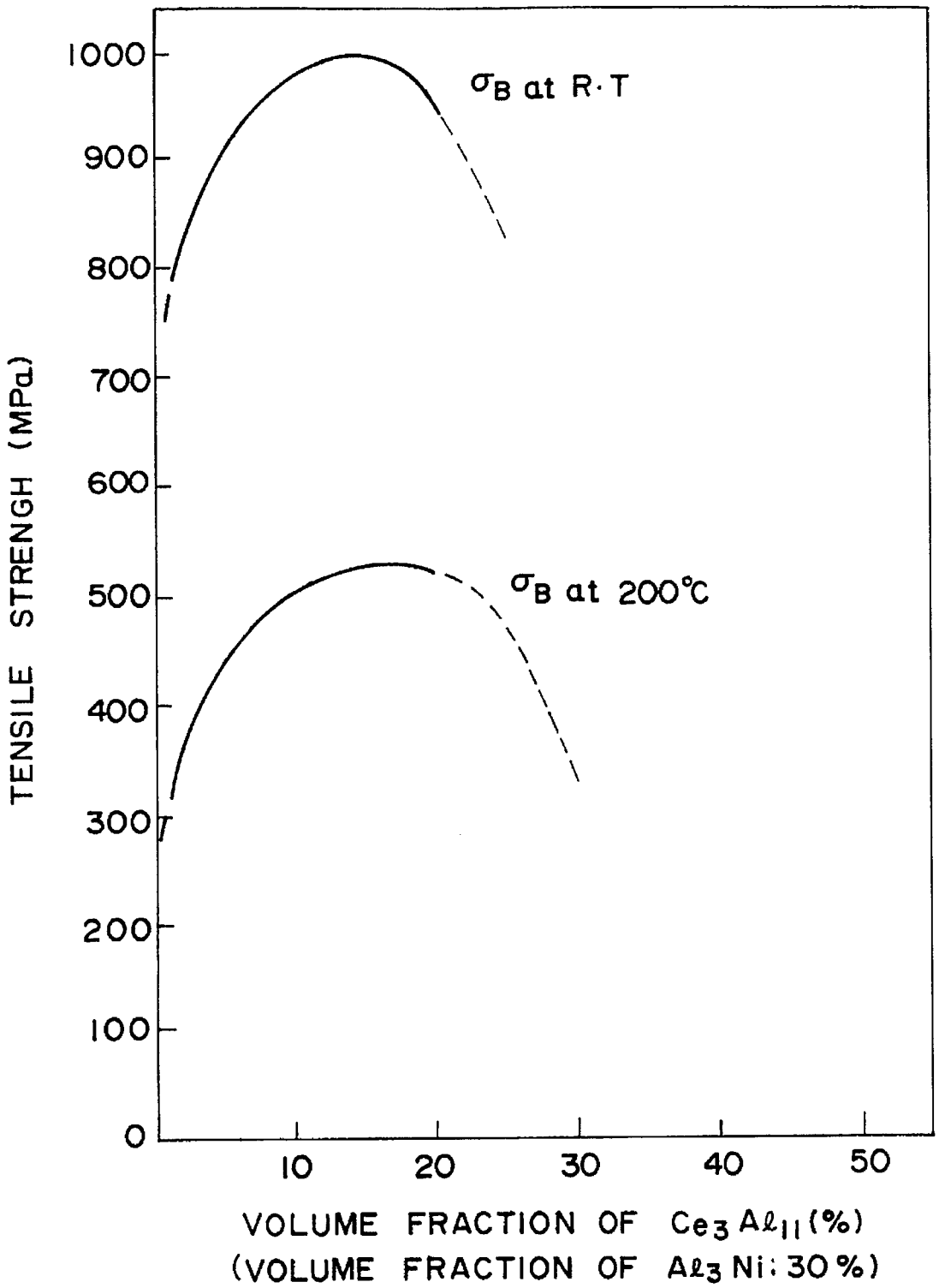

The results are shown in FIGS. 2 and 3.

In FIG. 2, the change in strength with the variation in the volume fraction of the $Al_3Ni$ intermetallic compound particles was determined through the use of a sample having a composition of $Al_{bal}Ni_{5-10}Ce_{1.5}$ with the volume fraction of the $Ce_3Al_{11}$ intermetallic compound particles being fixed to 10%.

In FIG. 3, the change in strength with the variation in the volume fraction of the $Ce_3Al_{11}$ intermetallic compound particles was determined through the use of a sample having a composition of $Al_{bal}Ni_{8-8.5}Ce_{1-4}$ with the volume fraction of the $Al_3Ni$ intermetallic compound particles being fixed to 30%.

As is apparent from FIG. 2, the strength at room temperature and the strength at a high temperature of 200° C. rapidly increased when the volume fraction of the $Al_3Ni$ intermetallic compound particles exceeded 19% and rapidly lowered when the volume fraction exceeded 40%. Further, as is apparent from FIG. 3, the strength at room temperature and the strength at a high temperature of 200° C. rapidly increased when the volume fraction of the $Ce_3Al_{11}$ intermetallic compound particles exceeded 1%. The strength at room temperature rapidly lowered when the volume fraction exceeded 20% and the strength at the high temperature rapidly lowered when the volume fraction exceeded 30%. The ductility at room temperature of the above-described samples became lower than the lower limit (2%) of the ductility necessary for general working when the volume fraction exceeded 40% for the $Al_3Ni$ intermetallic compound and exceeded 30% for the $Ce_3Al_{11}$ intermetallic compound.

EXAMPLE 2

Extruded materials (consolidated materials) consisting of various ingredients specified in Table 1 were prepared in the same manner as that of Example 1 to examine the mechanical properties (tensile strength) of these materials at room temperature. In the table, precipitated main intermetallic compound phases and their volume fractions are specified.

The results are given in Table 1

As is apparent from Table 1, the extruded materials (consolidated materials) of the present invention have an excellent tensile strength at room temperature.

All the extruded materials listed in the table exhibited an elongation exceeding the lower limit (2%) necessary for general working.

Also, the alloy of this Example comprised a matrix consisting of aluminum, or a supersaturated solid solution of aluminum, and having a mean crystal grain size of 40 to 1000 nm, and particles consisting of a stable phase or a metastable phase of various intermetallic compounds formed from the matrix element and other alloying elements and/or various intermetallic compounds formed from other alloying elements themselves were homogeneously distributed in the matrix. The mean size of the particles of intermetallic compounds was 10 to 800 nm.

TABLE 1

| | Composition of alloy (at. %) | Intermetallic compound phase | Volume fraction (%) | Tensile strength (MPa) |
|---|---|---|---|---|
| Comp. Ex. | $Al_{bal}Ni_4$ | $Al_3Ni$ | 14 | 811 |
| Invention Ex. 1 | $Al_{bal}Ni_8Mm_{1.5}$ | $Al_3Ni$, $Mm_3Al_{11}$ | 37 | 910 |
| Invention Ex. 2 | $Al_{bal}Ni_8Ce_2$ | $Al_3Ni$, $Ce_3Al_{11}$ | 40 | 810 |
| Invention Ex. 3 | $Al_{bal}Ni_7Zr_2$ | $Al_3Ni$, $Al_3Zr$ | 33 | 717 |
| Invention Ex. 4 | $Al_{bal}Ni_8Ti_{3.5}$ | $Al_3Ni$, $Al_3Ti$ | 42 | 934 |
| Invention Ex. 5 | $Al_{bal}Ni_6Mm_{0.5}$ | $Al_3Ni$, $Mm_3Al_{11}$ | 25 | 658 |
| Invention Ex. 6 | $Al_{bal}Ni_8La_{2.5}Cu_1$ | $Al_3Ni$, $La_3Al_{11}$ | 33 | 721 |
| Invention Ex. 7 | $Al_{bal}Ni_7Mm_{1.5}Zr_1$ | $Al_3Ni$, $Mm_3Al_{11}$, $Al_3Zr$ | 37 | 750 |
| Invention Ex. 8 | $Al_{bal}Ni_6Mm_4Y_1Mg_1$ | $Al_3Ni$, $Mm_3Al_{11}$, $Al_3Y$ | 48 | 1070 |
| Invention Ex. 9 | $Al_{bal}Ni_8Mm_{0.5}Zr_1Mg_1Si_1$ | $Al_3Ni$, $Mm_3Al_{11}$, $Al_3Zr$ | 36 | 897 |
| Invention Ex. 10 | $Al_{bal}Ni_7Mm_2Zr_1Mg_{1.5}Zn_1$ | $Al_3Ni$, $Mm_3Al_{11}$, $Al_3Zr$ | 40 | 922 |
| Invention Ex. 11 | $Al_{bal}Co_8Ce_{1.5}$ | $Al_9Co_2$, $Ce_3Al_{11}$ | 47 | 1032 |

TABLE 1-continued

| | Composition of alloy (at. %) | Intermetallic compound phase | Volume fraction (%) | Tensile strength (MPa) |
|---|---|---|---|---|
| Invention Ex. 12 | $Al_{bal}Co_8Mm_2$ | $Al_9Co_2$, $Mm_3Al_{11}$ | 42 | 923 |
| Invention Ex. 13 | $Al_{bal}Co_7Ti_2Cu_{0.5}$ | $Al_9Co_2$, $Al_3Ti$ | 36 | 820 |
| Invention Ex. 14 | $Al_{bal}Co_8Zr_{3.5}$ | $Al_9Co_2$, $Al_3Zr$ | 41 | 911 |
| Invention Ex. 15 | $Al_{bal}Co_6Mm_{1.5}$ | $Al_9Co_2$, $Mm_3Al_{11}$ | 38 | 818 |
| Invention Ex. 16 | $Al_{bal}Co_8La_{0.5}Mg_{0.5}$ | $Al_9Co_2$, $La_3Al_{11}$ | 45 | 953 |
| Invention Ex. 17 | $Al_{bal}Co_6Mm_{1.5}Zr_1$ | $Al_9Co_2$, $Mm_3Al_{11}$, $Al_3Zr$ | 39 | 837 |
| Invention Ex. 18 | $Al_{bal}Co_7Mm_3Y_1$ | $Al_9Co_2$, $Mm_3Al_{11}$, $Al_3Y$ | 45 | 1021 |
| Invention Ex. 19 | $Al_{bal}Co_7Mm_{0.5}Zr_1MG_1Si_1$ | $Al_9Co_2$, $Mm_3Al_{11}$, $Al_3Zr$ | 39 | 801 |
| Invention Ex. 20 | $Al_{bal}Co_8Mm_1Zr_1Mg_{1.5}$ | $Al_9Co_2$, $Mm_3Al_{11}$, $Al_3Zr$ | 46 | 906 |

As is apparent from the foregoing description, the rapidly solidified alloy according to the present invention has an excellent strength at room temperature and high temperature, as well as toughness. Further, it can maintain excellent properties inherent in a material produced by the rapid solidification process, even when it undergoes a thermal influence during working.

What is claimed is:

1. A high strength, rapidly solidified alloy of the general formula $$Al_{100-a-b}X_aM_b$$

wherein X represents at least one element selected from among La, Ce, Mm, Zr, Ti and Y;

M represents at least one metal selected from Ni and Co;

a and b are each an atomic %, provided that $0.1 \leqq a \leqq 5$ and $5 \leqq b \leqq 10$;

the volume fraction of an Al-X intermetallic compound is 1 to 30%; and the volume fraction of an Al-M intermetallic compound is 19 to 40%, wherein the mean crystal grain size of the aluminum is from 40 to 1000 nm, the mean particle size of a stable or metastable phase of various intermetallic compounds formed from the aluminum and an additive element and/or various intermetallic compounds formed from additive elements themselves is 10 to 800 nm, and the intermetallic compound particles are distributed in a volume fraction of 20 to 50% in a matrix consisting of the aluminum, said alloy having a tensile strength at room temperature of at least 658 MPa and an elongation at room temperature of at least 2%.

2. A high strength, rapidly solidified alloy of the general formula $$Al_{100-a-b}X_aM_b$$

wherein X represents at least one element selected from among La, Ce, Mm, Zr, Ti and Y;

M represents at least one metal selected from Ni and Co;

a and b are each an atomic %, provided that $0.1 \leqq a \leqq 5$ and $5 \leqq b \leqq 10$;

the volume fraction of an Al-X intermetallic compound is 1 to 30%; and the volume fraction of an Al-M intermetallic compound is 19 to 40%, wherein the mean crystal grain size of the aluminum is from 40 to 1000 nm, the mean particle size of a stable or metastable phase of various intermetallic compounds formed from the aluminum and an additive element and/or various intermetallic compounds formed from additive elements themselves is 10 to 800 nm, and the intermetallic compound particles are distributed in a volume fraction of 20 to 50% in a matrix consisting of the aluminum, the Al-X intermetallic compound comprising at least one of $Ce_3Al_{11}$, $Al_4Ce$, $Mm_3Al_{11}$, $Al_3Ti$ and $Al_3Zr$ and the Al-M intermetallic compound comprising at least one of $Al_3Ni$ and $Al_9Co_2$, said alloy having a tensile strength at room temperature of at least 658 MPa and an elongation at room temperature of at least 2%.

3. A high strength, rapidly solidified alloy of the general formula $$Al_{100-a-b-c}X_aM_bQ_c$$

wherein X represents at least one element selected from among La, Ce, Mm, Zr, Ti and Y;

M represents at least one metal selected from Ni and Co;

Q represents at least one element selected from among Mg, Si, Cu and Zn;

a, b and c are each an atomic %, provided that $0.1 \leqq A \leqq 5$, $5 \leqq b \leqq 10$ and $0.1 \leqq c \leqq 2$;

the volume fraction of an Al-X intermetallic compound is 1 to 30%; and the volume fraction of an Al-M intermetallic compound is 19 to 40%, wherein the mean crystal grain size of the aluminum is from 40 to 1000 nm, the mean particle size of a stable or metastable phase of various intermetallic compounds formed from the aluminum and an additive element and/or various intermetallic compounds formed from additive elements themselves is 10 to 800 nm, and the intermetallic compound particles are distributed in a volume fraction of 20 to 50% in a matrix consisting of the aluminum, said alloy having a tensile strength at room temperature of at least 658 MPa and a room temperature elongation of at least 2%.

4. A high strength, rapidly solidified alloy of the general formula $Al_{100-a-b-c}X_aM_bQ_c$ wherein X represents at least one element selected from among La, Ce, Mm, Zr, Ti and Y;

M represents at least one metal selected from Ni and Co;

Q represents at least one element selected from among Mg, Si, Cu and Zn;

a, b and c are each an atomic %, provided that $0.1 \leqq a \leqq 5$, $5 \leqq b \leqq 10$ and $0.1 \leqq c \leqq 2$;

the volume fraction of an Al-X intermetallic compound is 1 to 30%; and the volume fraction of an Al-M intermetallic compound is 19 to 40%, wherein the mean crystal grain size of the aluminum is from 40 to 1000 nm, the mean particle size of a stable or metastable phase of various intermetallic compounds formed from the aluminum and an additive element and/or various intermetallic compounds formed from additive elements themselves is 10 to 800 nm, and the intermetallic compound particles are distributed in a volume fraction of 20 to 50% in a matrix consisting of the aluminum, the Al-X intermetallic compound comprising at least one of $Ce_3Al_{11}$, $Al_4Ce$, $Mm_3Al_{11}$, $Al_3Ti$ and $Al_3Zr$ and the Al-M intermetallic compound comprising at least one of $Al_3Ni$ and $Al_9CO_2$, said alloy having a tensile strength at room temperature of at least 658 MPa and an elongation at room temperature of at least 2%.

* * * * *

UNITED STATES PATENT AND TRADEMARK OFFICE

CERTIFICATE OF CORRECTION

PATENT NO. : 5 647 919

DATED : July 15, 1997

INVENTOR(S) : Kazuhiko KITA et al

It is certified that error appears in the above-indentified patent and that said Letters Patent is hereby corrected as shown below:

Column 8, line 50; change "0.1 ≤ A" to ---0.1 ≤ a---.

Signed and Sealed this

Eleventh Day of November, 1997

*Attest:*

Bruce Lehman

BRUCE LEHMAN

*Attesting Officer*

*Commissioner of Patents and Trademarks*